United States Patent [19]

Williams

[11] Patent Number: 4,860,904

[45] Date of Patent: Aug. 29, 1989

[54] PAPER STACKER

[76] Inventor: Henry R. Williams, 138-16 232nd St., Laurlton, N.Y. 11413

[21] Appl. No.: 220,905

[22] Filed: Jul. 19, 1988

Related U.S. Application Data

[63] Continuation of Ser. No. 1,960, Jan. 9, 1987, abandoned.

[51] Int. Cl.[4] ..... A47F 7/00

[52] U.S. Cl. ..... 211/50; 206/555

[58] Field of Search ..... 211/50, 45, 175; 248/407; D19/90, 92; 206/449, 425, 555

[56] References Cited

U.S. PATENT DOCUMENTS

| | | | |
|---|---|---|---|
| D. 226,241 | 1/1973 | Zelenco | D19/92 |
| D. 245,170 | 7/1977 | Evenson | D19/92 |
| D. 255,037 | 5/1980 | Grunstand | D19/92 |
| D. 271,402 | 11/1983 | Sharber | D19/92 |
| 2,331,175 | 10/1943 | Connor et al. | 211/50 X |
| 3,086,658 | 4/1963 | Palmer | 211/50 |
| 3,469,870 | 9/1969 | Barkus | 248/407 X |
| 3,861,638 | 1/1975 | Tong | 248/407 |
| 4,444,319 | 4/1984 | Sharber | 211/50 |

*Primary Examiner*—Ramon O. Ramirez

*Attorney, Agent, or Firm*—Stephen E. Feldman

[57] ABSTRACT

A back, two sides continuously decreasing in height from the back toward the front, a bottom and a front, significantly lower than the back, are secured together to form a paper stacker. The bottom is doomed at is midpoint between the sides with the dome extending from the front to the back. A pair of quarter round moldings are disposed at the juncture of the sides and bottom and extend from the front to the back. Thus, there is formed a right parallelapiped with an essentially open front and slopping sides. The back can be extended by an extension attached to the stacker by teats which are attached to the sides of the extension and fit into slots extending through the back of the stacker at the junction with the sides allowing the back of the stacker and extension to form a coplanar surface when so attached. Multiple slots and teats are deployed at essentially equal intervals.

3 Claims, 2 Drawing Sheets

FIG. 4
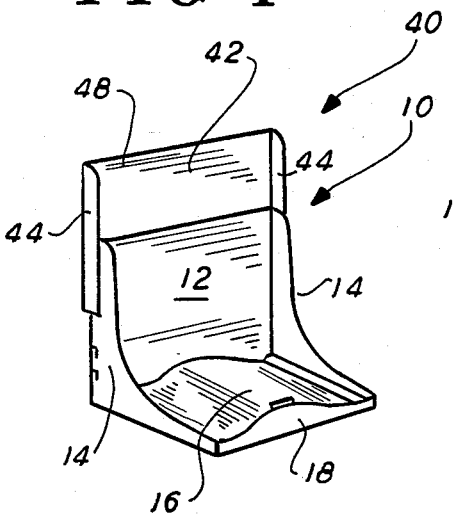
FIG. 5
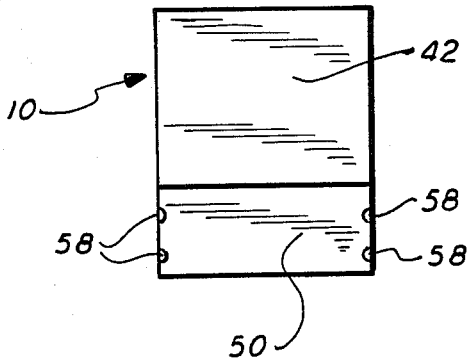
FIG. 7
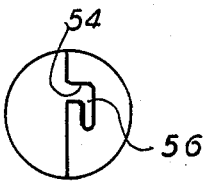
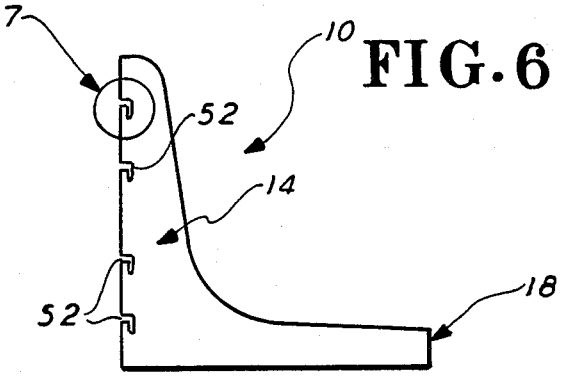
FIG. 6
FIG. 8
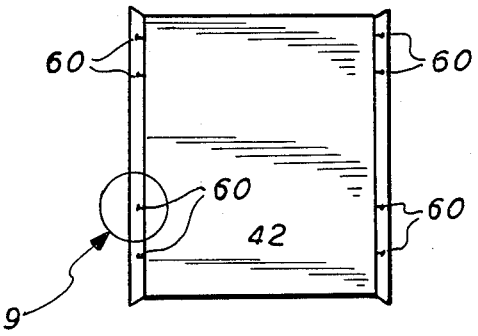
FIG. 9
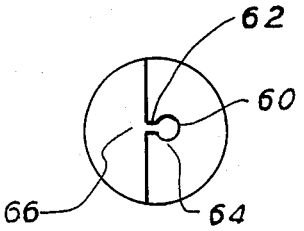

PAPER STACKER

This application is a continuation of application Ser. No. 001,960, filed 1/09/87 now abandoned.

BACKGROUND OF THE INVENTION-FIELD OF APPLICATION

This invention relates to paper stackers; and more particularly to a paper stacker for stacking paper at high speeds.

BACKGROUND OF THE INVENTION-DESCRIPTION OF THE PRIOR ART

Storage, dispensing, display, holding and accumulating devices, and the like, for paper and cards seem to be somewhat known and are available. A stacker may be considered to be any of these. The loading or accumulation of paper, cards or the like, as well as the dispensing of the same has progressed from totally manual procedures to ones which may be fully automatic.

The manner of handling automatic feeds of paper, at high speeds, has been known in the printing industry for many years. Computers with their intrinsically fast production of data has also resulted in printers which spew line upon line of printed matter at astonishingly fast rates. Consequently, these printers produce large quantities of "continuous feed" pages which fold one upon the other. Accumulation and storage of such printed matter is of significant importance.

Various types of card holders have been devised. M. H. Malwitz, for example, shows one in his U.S. Pat. No. 1,533,880 for Card Holder issued Apr. 14, 1925. This holder, however, seems to be limited to manual loading. U.S. Pat. No. 2,331,175 issued to R. Conner et al on Oct. 5, 1943 for Card Support shows a device designed specifically to support a stack of "Keysort" cards which characteristically have been cut away to form a notch intermediate a perforation and an edge of the card and in U.S. Pat. No. 3,086,658 issued Apr. 23, 1963 to G. E. Palmer for Cardholder there is also shown a holder that must be manually loaded.

U.S. pat. No. 4,444,319 issued Apr. 24, 1984 to J. L. Sharber for Note Paper Retrieval Tray requires an inclined bottom wall with a depression formed therein so that when removing cards from the stack a thumb or finder must be pressed downward on the stack at the location of the depression. The Sharber device does not appear to be suitable for automatically stacking paper or cards.

U.S. Pat. No. 46,405 issued Sept. 15, 1914 to F. P. MacLehman for Newspaper Dispensing Device and U.S. Pat. No. 3,129,819 issued Apr. 21, 1964 to J. H. Chandler for Newspaper Storage and Baling Rack, both show constructions which appear to facilitate stacking of newspapers but which do not appear to be suitable for automatic paper stacking.

Printer stands used for supporting a computer printer with a bailer or stacker is shown by both C. J. Mueller in U.S. Pat. No. 4,544,065 issued Oct. 1, 1985 for Printer Stand and M. E. Murphy in U.S. Pat. No. 4,570,802 issued Feb. 18, 1986 for Printer Stand. While both show the printer support at an angle and storage space for feeding and accumulating paper which is continuously fed neither have rear, side and bottom wall constructions which not only facilitate stacking and folding, but also removal of the stack from the device.

SUMMARY OF THE INVENTION

It is therefore an object of this invention to provide a new and improved paper stacker.

It is a further object of this invention to provide a new and improved paper stacker with a back.

It is still further an object of this invention to provide a new and improved paper stacker with a back and sides.

It is a further object of this invention to provide a new and improved paper stacker with a back, cut-away sides and curved floor to allow for easy stacking and removal of paper fed at high speeds.

It is yet another object of this invention to provide a new and improved paper stacker with an adjustable back.

It is yet still another object of this invention to provide a new and improved paper stacker for automatic stacking from a high speed printer.

BRIEF DESCRIPTION OF THE DRAWING

FIG. 4 is a perspective view of the paper stacker of FIG. 1 with an extension member associated therewith;

FIG. 5 is a rear view of the paper stacker and extention shown in FIG. 4;

FIG. 6 is a side view of the paper stacker of FIG. 4;

FIG. 7 is an enlarged view of an extension attachment key of the paper stacker of FIG. 6;

FIG. 8 is a front view of the extension member of FIGS. 4 and 5; and FIG. 9 is an enlarged view of a teat shown in circled portion 9 of FIG. 8.

BRIEF DESCRIPTION OF THE PREFERRED EMBODIMENT

Figure 1:
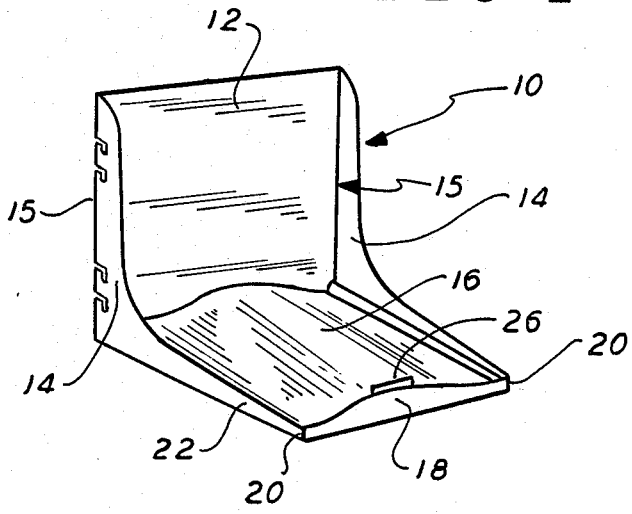
FIG. 1 is a perspective view of a paper stacker incorporating the instant invention.

With reference to FIG. 1, there is generally shown at 10 a paper stacker. A back 12 of stacker 10, is essentially in the configuration of a rectangle of predetermined height, width and thickness and is disposed in a substantially vertical plane. Fixedly attached to back 12 are a pair of sides 14 which extend outwardly therefrom along edges 15 thereof and along a bottom 16 which also extends forward from back 12. Sides 14 are mutually parallel and are disposed essentially perpendicular to back 12 and bottom 16 in vertical planes. A front 18 is fixedly attached to sides 14 at front ends 20 thereof and along a front edge of bottom 16.

Sides 14 extend vertically up to a height essentially equal to that of back 12 and horizontally forward along side edges of bottom 16. The vertical and horizontal portions of sides 14 meet at curved portions 22. The configuration of side walls 14 facilitates easy access to the paper stacked in paper stacker 10 when removing same.

Figure 2:
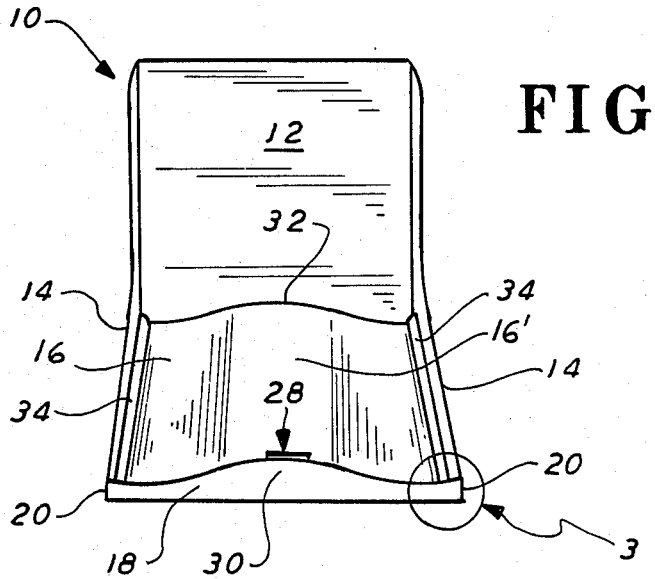
FIG. 2 is a frontal view of the paper stacker of FIG. 1.

Front 18 is symmetrical in shape having a pair of outer ends 34 which terminate at front ends 20 of sides 14 and is of a height at its ends essentially equal to ends 20. Proximate the center of front 18 is a lip 26 having a height 28 and length 30. Front 18 increases in height gradually and symmetrically from each of its outer ends 34 to an apex 32 located proximate its center (FIG. 2). The configuration of front wall 18 and of lip 26 and its disposition is to keep paper, when stacked in stacker 10, from shifting forward. Rear wall 12 is utilized to keep the paper from shifting backward.

Bottom 16 (FIGS. 1 and 2) has essentially the same configuration as front 18 (excluding leg 26) with a width substantially equal to the width of back 12, and a length essentially equal to the length of sides 14. Bottom 16 includes a raised mid-section 16'. The raised or bridged mid-section 16' of bottom 16 keeps the paper raised from the lower mid-section and facilitates folding once the height of the stacked paper has increased.

Figure 3:
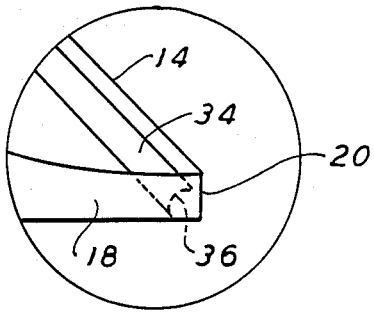
FIG. 3 is an a view of a protion of FIG. 2.

A molding 34 (FIGS. 1, 2 and 3) is disposed along the intersection of sides 14 and bottom 16. Molding 34 is in the form a quarter round strip having a predetermined radius and a predetermined length essentially equal to the length of sides 14. Molding 34 prevent the paper from shifting from side to side and help keep the paper centered for better fold control.

FIGS. 4 and 5 generally show an extension 40 removably attached to paper stacker 10. Extension 40 includes a back 42 of a width substantially equal to the width of back 12 of stacker 10 plus two thickness of sides 14 and a predetermined clearance amount. A pair of sides 44 extend forward from back 42 and are formed to be mutually parallel and perpendicular to back 42 and so that all are disposed in a vertical plane. A front surface 48 of back 42 of extension 40 and a back surface 50 of back 12 of stacker 10 are essentially co-planner when extension 40 is disposed as shown in FIGS. 4 and 5.

A plurality of slots 52 (FIG. 6) are disposed proximate edges 15 of sides 14 at essentially equal intervals. In FIG. 7 slot 52 is shown to have a first portion 54 and a second portion 56 both of which extend through the thickness of sides 14, and may be formed by punching, notching, sawing or the like. Similarly, rear slots 58 (FIG. 5) are disposed to coact with slots 52. Slots 58 are inwardly extending through back 12 and are formed in a manner as slots 52, (i.e. in the shape of a three quarter moon).

A plurality of teats 60 (FIGS. 8 and 9) are disposed at essentially equal intervals on sides 44 and are perpendicular thereto and extend inwardly. Teats 60 each have a shank portion 62 (FIG. 9) which is essentially cylindrical and a ball end 64 integrally attached thereto. Teats 60 are each fixedly attached to sides 44 at an end 66 thereof as by riveting, welding or the like. Teats 60 each extend inward toward the center of back 42.

When mounting extension 40 onto stacker 10 teats 60 are inserted through appropriate rear slots 58 into portion 54 of slots 52 and then into portions 56 of slots 52 at which time extension 40 will be properly seated.

It should be understood that although I have shown the preferred embodiment of my invention that various modifications may be made in the details thereof without departing from the spirit as comprehended by the following claims.

What is claimed is:

1. A paper stacker for stacking paper at high speed, said stacker comprising:

(a) a back panel disposed in an essentially vertical plane and having a first width;

(b) a pair of side panels fixedly attached to said back panel, said side panels being mutually parallel to each other and perpendicular to said back panel and spaced from each other said first width, said side panels extending forward from said back panel a predetermined distance to a front panel, said side panels being curved downward from said back panel to said front panel in a continuously downward curve to said front panel;

(c) said front panel fixedly attached to said side panels at front end thereof, said front panel being significently lower than said back panel;

(d) a bottom panel generally rectangular in shape fixedly attached to said back panel and to said front panel and to said side panels proximate a lower edge of each and having a non-plane surface said bottom panel having a width defined by said side panels, said bottom panel having a raised portion disposed essentially at an apex proximate a midpoint between said side panels, said raised portion extending said extending said predetermined distance between said front panel but less than the width of said bottom panel; and (e) molding means disposed along the intersection of said bottom panel and a side panel, said molding means extending essentially parallel with said raised portion and extending said predetermined distance so as to make the width of said bottom panel virtually shorter than said first width.

2. A paper stacker as in claim 1 wherein said front panel has a shape equivalent to the corresponding section of said bottom panel and includes a lip extending upward at said apex.

3. A paper stacker as in claim 1 wherein said molding means are each quarter round in cross section.

* * * * *